US008670682B2

(12) United States Patent
Lee

(10) Patent No.: US 8,670,682 B2
(45) Date of Patent: Mar. 11, 2014

(54) IMAGE FORMING APPARATUS WITH PAPER PRESENCE AND PAPER WIDTH SENSOR

(75) Inventor: Min Chul Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 380 days.

(21) Appl. No.: 12/926,740

(22) Filed: Dec. 7, 2010

(65) Prior Publication Data

US 2011/0158729 A1 Jun. 30, 2011

(30) Foreign Application Priority Data

Dec. 24, 2009 (KR) ..... 10-2009-131125

(51) Int. Cl.
*G03G 15/00* (2006.01)
*B41J 13/10* (2006.01)
*B65H 7/04* (2006.01)

(52) U.S. Cl.
USPC ..... 399/23; 399/389; 400/624; 400/708

(58) Field of Classification Search
CPC ..... B65H 2553/83; B65H 2553/80; G03G 2215/00628
USPC ..... 399/388, 389, 320, 334, 328, 23; 400/624, 629, 708; 271/258.01, 259, 271/265.03, 265.01, 265.02, 38, 110, 145, 271/162, 171
See application file for complete search history.

(56) References Cited

U.S. PATENT DOCUMENTS

| | | | | |
|---|---|---|---|---|
| 5,842,694 | A * | 12/1998 | Brooks et al. | 271/38 |
| 6,292,636 | B1 * | 9/2001 | Kwon | 399/16 |
| 2003/0215274 | A1 * | 11/2003 | Ahn | 399/388 |
| 2004/0061283 | A1 * | 4/2004 | Hyun | 271/265.01 |
| 2009/0067907 | A1 * | 3/2009 | Maddux et al. | 399/389 |

FOREIGN PATENT DOCUMENTS

| | | | |
|---|---|---|---|
| JP | 63027350 A | * | 2/1988 |
| JP | 02110028 A | * | 4/1990 |
| JP | 04136882 A | * | 5/1992 |
| JP | 11116097 A | * | 4/1999 |
| JP | 2003226444 A | * | 8/2003 |

* cited by examiner

*Primary Examiner* — Daniel J Colilla
(74) *Attorney, Agent, or Firm* — Staas & Halsey LLP

(57) ABSTRACT

An image forming apparatus realizes two functions using a single actuator to sense the width and presence of a printing medium and a single sensor to sense operation of the actuator, resulting in reduced manufacturing costs.

9 Claims, 9 Drawing Sheets

IMAGE FORMING APPARATUS WITH PAPER PRESENCE AND PAPER WIDTH SENSOR

CROSS-REFERENCE TO RELATED APPLICATIONS

This application claims the benefit of Korean Patent Application No. 2009-0131125, filed on Dec. 24, 2009 in the Korean Intellectual Property Office, the disclosure of which is incorporated herein by reference.

BACKGROUND

1. Field

Embodiments relate to an image forming apparatus to simultaneously sense the presence of printing media stored in a cassette and a width of the printing media.

2. Description of the Related Art

Generally, image forming apparatuses are devised to print an image on a printing medium according to input image signals. Examples of image forming apparatuses include printers, copiers, fax machines, and devices combining functions thereof.

An electro-photographic image forming apparatus includes a paper supply unit in which a plurality of printing media is stored, a developing unit to form an image on a printing medium supplied from the paper supply unit by use of developer, a fusing unit to fuse the developer present on the printing medium, and a discharge unit to discharge the printing medium, on which the image has been completely formed, to the outside.

The paper supply unit to supply the printing media for use in the image forming apparatus includes a paper supply cassette in which the printing media is stored, and a paper sensing device to sense the presence of printing media supplied into the paper supply cassette.

The fusing unit serves to fuse toner, i.e. the developer, to the printing medium and to this end, adopts a heat source. To control a temperature of the heat source or a printing speed of the image forming apparatus according to various widths of printing media, the image forming apparatus is provided with a sensor to sense a width of printing media.

SUMMARY

Therefore, it is an aspect to provide an image forming apparatus to sense the presence and width of printing media by use of a single actuator.

Additional aspects will be set forth in part in the description which follows and, in part, will be apparent from the description, or may be learned by practice of the invention.

In accordance with one aspect, an image forming apparatus includes a body having a printing path, a paper supply tray separably mounted in the body, in which a printing medium is stored, a first sensor including a light emitting element and a light receiving element arranged to face each other, the first sensor generating a sensed signal as the light receiving element receives light emitted from the light emitting element, and a first actuator including a first actuating arm to sense the presence of the printing medium stored in the paper supply tray by coming into contact with and being moved by the printing medium, a second actuating arm to sense a width of the printing medium by selectively coming into contact with and being moved by the printing medium fed to the printing path according to the width of the printing medium, and a first sensing arm to intercept the light that would otherwise be transmitted to the light receiving element by being moved in linkage with the first actuating arm and the second actuating arm.

The first actuating arm, the second actuating arm and the first sensing arm may have the same first rotating shaft and may be arranged at positions spaced apart from one another on the first rotating shaft.

The first sensing arm may be positioned so as not to be sensed by the light receiving element when no printing medium is stored in the paper supply tray, and may be positioned so as to be sensed by the light receiving element when the printing medium is stored in the paper supply tray.

The width of the printing medium coming into contact with the second actuating arm may be at least about 190 mm.

The first sensing arm may be positioned so as to be sensed by the light receiving element when the second actuating arm does not come into contact with the printing medium, and may be positioned so as not to be sensed by the light receiving element when the second actuating arm comes into contact with the printing medium.

The image forming apparatus may further include a second sensor including a light emitting element and a light receiving element arranged to face each other, the second sensor generating a sensed signal as the light receiving element receives light emitted from the light emitting element, and a second actuator including a third actuating arm to sense whether or not the printing medium is fed to the printing path defined in the body by coming into contact with and being moved by a front end of the printing medium, and a second sensing arm to intercept the light that would otherwise be transmitted to the light receiving element of the second sensor by being moved in linkage with the third actuating arm.

The second sensing arm may be positioned so as to be sensed by the second sensor when the printing medium is not fed to the printing path, and may be positioned so as not to be sensed by the second sensor when the third actuating arm comes into contact with the printing medium fed to the printing path.

The image forming apparatus may further include a fusing unit to fuse an image transferred to the printing medium supplied from the paper supply tray by applying heat and pressure to the transferred image, and a controller to control the image forming apparatus according to the sensed signal of the first sensor or the second sensor, wherein the controller decreases a printing speed of the image forming apparatus or a fusing temperature of the fusing unit, to prevent abnormal heat generation of the fusing unit when the first sensor is in a sensing state and the second sensor is in a non-sensing state.

In accordance with another aspect, an image forming apparatus includes a body having a printing path, a paper supply tray separably mounted in the body, in which a printing medium is stored, a pickup member to pick up the printing medium stored in the paper supply tray sheet by sheet and to feed the picked up printing medium to the printing path, a first actuator to sense the presence of the printing medium stored in the paper supply tray and a width of the printing medium, and a first sensor to sense operation of the first actuator, wherein the first actuator includes a first rotating shaft rotatably installed to one side of the body, a first actuating arm extending from a first axial portion of the first rotating shaft and having a first contact portion to face a front end of the printing medium stored in the paper supply tray, a second actuating arm extending from a second axial portion of the first rotating shaft and having a second contact portion to selectively come into contact with the printing medium according to the width of the printing medium that has picked up by the pickup member so as to be fed to the printing path, and a first sensing arm extending from a third axial portion of the first rotating shaft and having a first sensing portion to be sensed by the first sensor by being moved in linkage with the first and second actuating arms.

The first actuating arm, the second actuating arm and the first sensing arm may be integrally formed with the first rotating shaft.

The width of the printing medium coming into contact with the second contact portion may be at least about 190 mm.

The first actuator may be rotatable between a first position where the first actuator is rotated downward by gravity, a second position where the first contact portion comes into contact with and is rotated by the front end of the printing medium stored in the paper supply tray, and a third position where the second contact portion comes into contact with and is rotated by the printing medium fed to the printing path.

The first sensing portion may be not sensed by the first sensor at the first position, may be sensed by the first sensor at the second position, and may be not sensed by the first sensor at the third position.

The first sensor may be a photo sensor including a light emitting element and a light receiving element, and may be movable into or out of a sensing space defined between the light emitting element and the light receiving element.

The image forming apparatus may further include a second actuator to sense whether or not the printing medium is fed to the printing path, and a second sensor to sense operation of the second actuator, wherein the second actuator includes a second rotating shaft rotatably installed to the body, a third actuating arm extending from the second rotating shaft in a first direction toward the printing path and having a third contact portion at an end thereof spaced apart from the second rotating shaft so as to come into contact with the printing medium that has picked up by the pickup member so as to be fed to the printing path, and a second sensing arm extending from the second rotating shaft in a second direction toward the second sensor and having a second sensing portion to be sensed by the second sensor.

The second actuator may be rotatable between a first position where the second actuator is rotated downward by gravity so that the third contact portion protrudes to the printing path and a second position where the third contact portion comes into contact with and is rotated by the printing medium.

The second sensing portion may be sensed by the second sensor at the first position, and may be not sensed by the second sensor at the second position.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
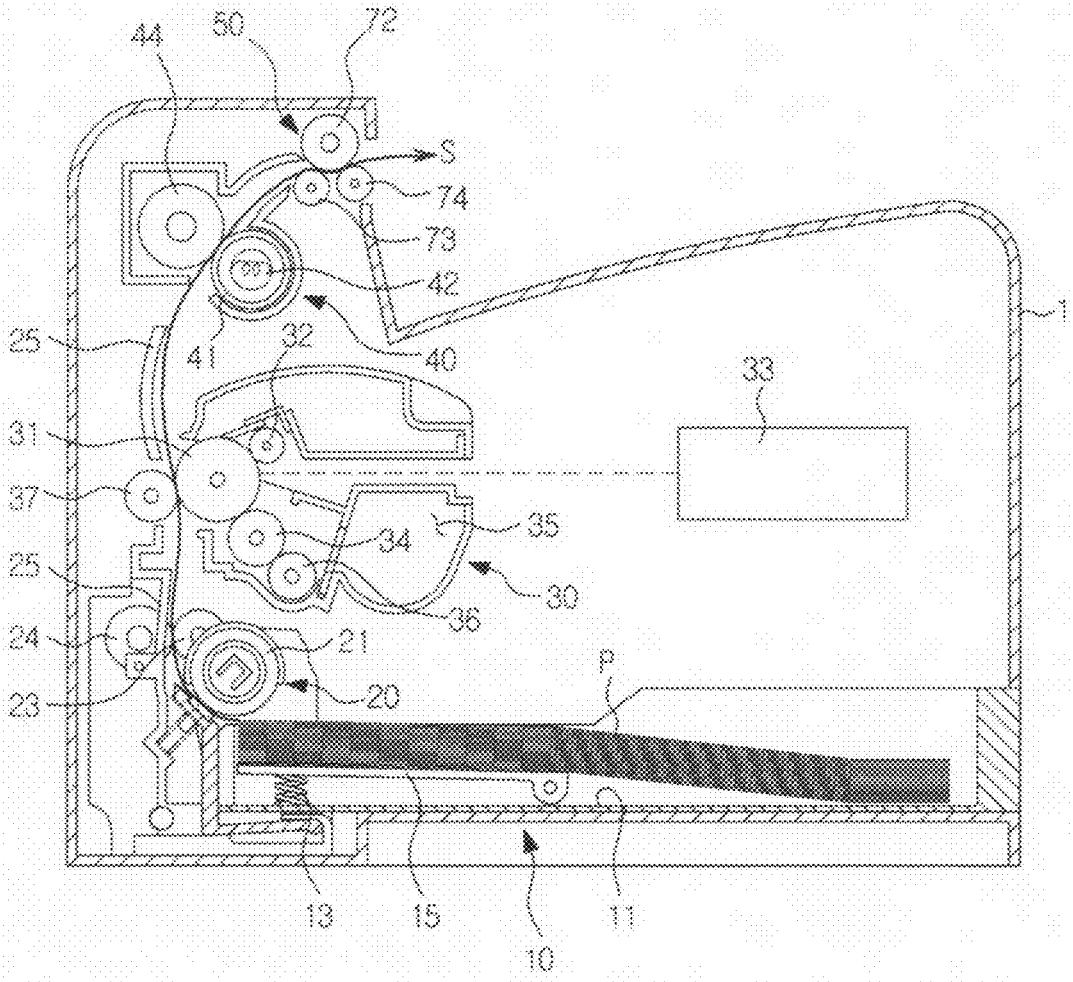
FIG. 1 is a view illustrating a schematic configuration of an image forming apparatus according to an embodiment.

Reference will now be made in detail to the embodiments, examples of which are illustrated in the accompanying drawings, wherein like reference numerals refer to like elements throughout.

FIG. 1 is a view illustrating a schematic configuration of an image forming apparatus according to an embodiment.

Referring to FIG. 1, the image forming apparatus according to the embodiment includes a body 1 defining an exterior appearance of the image forming apparatus, a paper supply unit 10 provided in the body 1 on a printing path S of a printing medium P, a developing unit 30, a fusing unit 40, and a discharge unit 50.

The paper supply unit 10 serves to store and feed the printing medium P and is installed in a lower region of the body 1 so as to feed the printing medium P toward the developing unit 30.

The paper supply unit 10 may include a paper supply tray 11 in the form of a cassette separable from the body 1, in which the printing medium P is stored, and a feed unit 20 to pick up the printing medium P stored in the paper supply tray 11 sheet by sheet so as to feed the printing medium P toward the developing unit 30.

A knock-up plate 15 may be installed in the paper supply tray 11 to guide the printing medium P stored in the paper supply tray 11 to the feed unit 20. To this end, one end of the knock-up plate 15 may be rotatably coupled to the bottom of the paper supply tray 11, and the other end may be supported by a press spring 13.

The feed unit 20 may include a pickup member 21 to pick up the printing medium P stacked on the knock-up plate 15 sheet by sheet, a feed roller 23 and a backup roller 24 to feed the printing medium P picked up by the pickup member 21 toward the developing unit 30, and feed guides 25 to define the printing path S.

The developing unit 30 is arranged on the printing path S above the feed unit 20 and serves to form an image on the printing medium P fed from the paper supply unit 10.

The developing unit 30 may include a photoconductor 31, a charge roller 32 to charge the photoconductor 31, a light scanning unit 33 to form an electrostatic latent image on a surface of the photoconductor 31 by irradiating a laser beam to the charged photoconductor 31 based on an image signal, a developing roller 34 to develop the electrostatic latent image into a developer image by attaching developer to the electrostatic latent image formed on the photoconductor 31, a supply roller 36 to supply the developer of a developer reservoir 35 to the developing roller 34, and a transfer roller 37 to transfer the image formed on the photoconductor 31 to the printing medium P.

The photoconductor 31 may serve as an image carrier to carry the developer image thereon and may take the form of a drum. When the light scanning unit 33 irradiates a laser beam to the photoconductor 31 based on image information, the electrostatic latent image is formed on the surface of the photoconductor 31.

The charge roller 32 serves to charge the surface of the photoconductor 31 with a predetermined electric potential. To this end, the charge roller 32 applies electric charge to the surface of the photoconductor 31 while performing frictional rotation in contact with the surface of the photoconductor 31.

The developing roller 34 serves to develop the electrostatic latent image formed on the photoconductor 31 into a developer image by supplying the developer to the photoconductor 31. The developing roller 34 may be provided to supply the developer to the photoconductor 31 in a contact or non-contact manner.

The supply roller 36 serves to supply the developer stored in the developer reservoir 35 to the developing roller 34. The developer supplied to the developing roller 34 may define a developer layer having a constant thickness under operation of a leveling member.

With the above described configuration, as the light scanning unit 33 forms an electrostatic latent image on the surface of the photoconductor 31 that has been charged with a predetermined electric potential by the charge roller 32 and the supply roller 36 and the developing roller 34 are operated to develop the electrostatic latent image using the developer stored in the developer reservoir 35, a visible image consisting of developer powder is formed on the photoconductor 31.

The transfer roller 37 acts to press the printing medium P toward the photoconductor 31 thus allowing the visible image formed on the photoconductor 31 to be transferred to the surface of the printing medium P by a transfer nip as the printing medium P passes between the photoconductor 31 and the transfer roller 37.

The printing medium P, which has passed through the developing unit 30 and contains the visible image formed thereon, is guided to the fusing unit 40. To this end, one of the feed guides 25 is arranged on the printing path S above the developing unit 30.

The fusing unit 40 serves to heat and fuse the visible image transferred to the printing medium P. The fusing unit 40 includes a heating member 41 in which a heat source 42 is accommodated, and a press roller 44 to press the printing medium P toward the heating member 41.

The heating member 41 may be a heating roller accommodating the heat source 42 therein, or may be a heating belt to be heated by the heat source 42.

The fusing unit 40 applies heat and pressure to the visible image transferred to the printing medium P as the printing medium P passes through a fusing nip between the heating member 41 and the press roller 44 of the fusing unit 40, thereby allowing the visible image to be fused to the printing medium P.

The discharge unit 50 serves to discharge the printing medium P, which has passed through the fusing unit 40 and contains the fused visible image, from the top of the body 1.

The discharge unit 50 includes a plurality of discharge rollers 72, 73 and 74 arranged on the printing path S to define a discharge path of the printing medium P.

Figure 2:
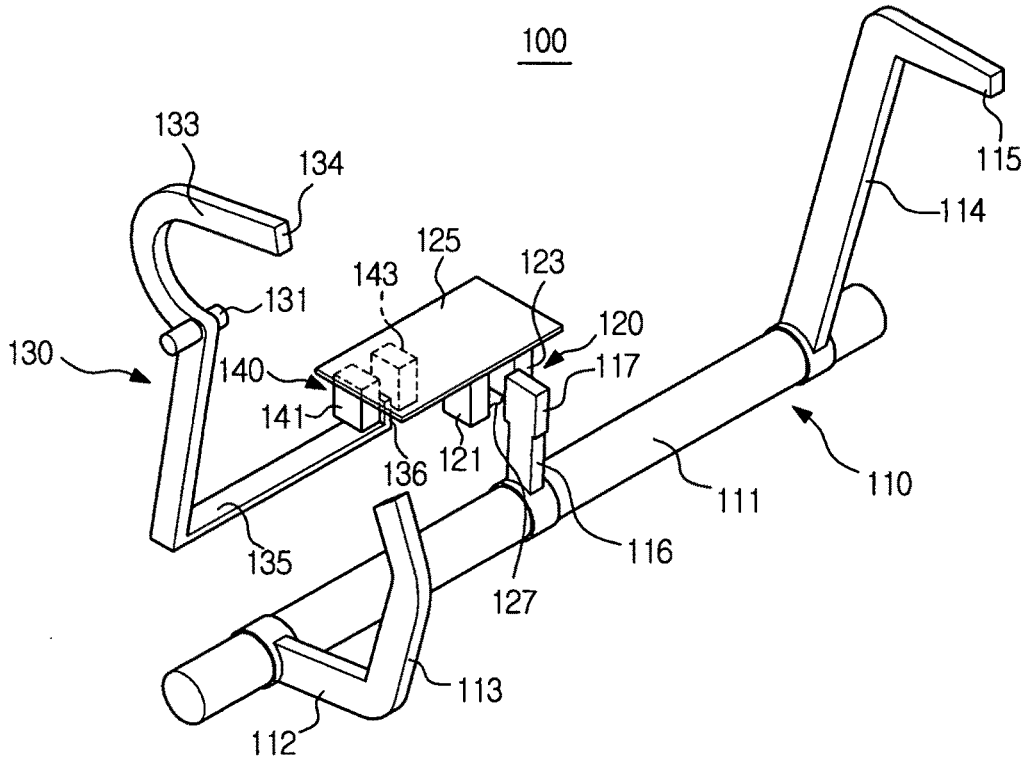
FIG. 2 is a perspective view of a printing medium sensing unit according to the embodiment.
Figure 3:
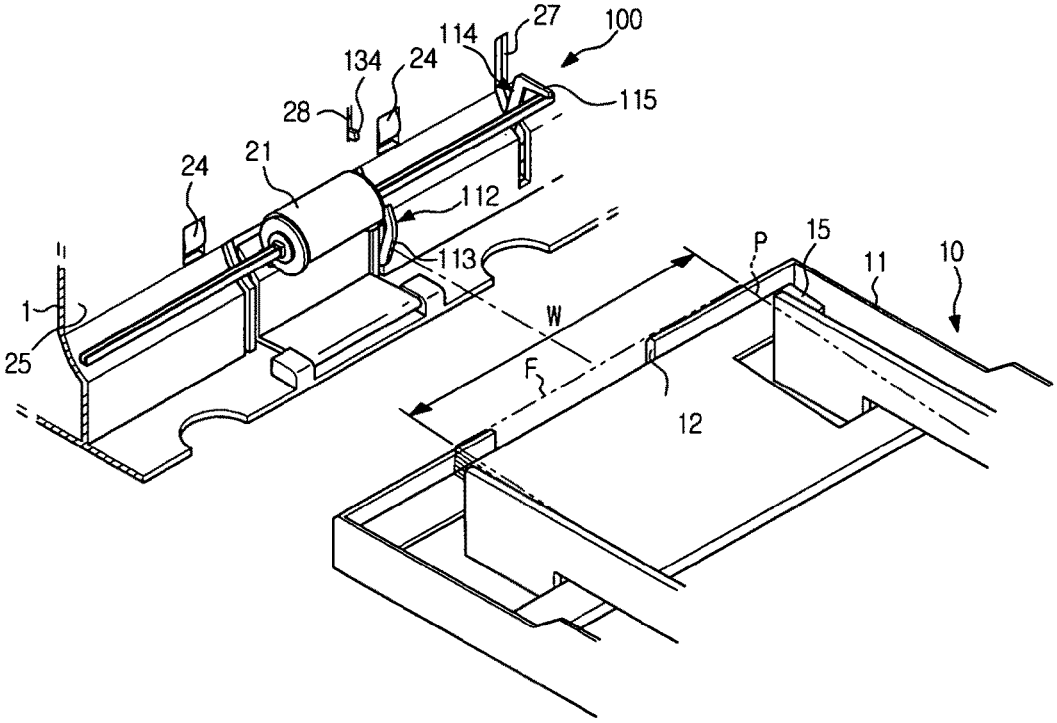
FIG. 3 is a view illustrating a relationship between a paper supply unit and the printing medium sensing unit according to the embodiment.
Figure 4:
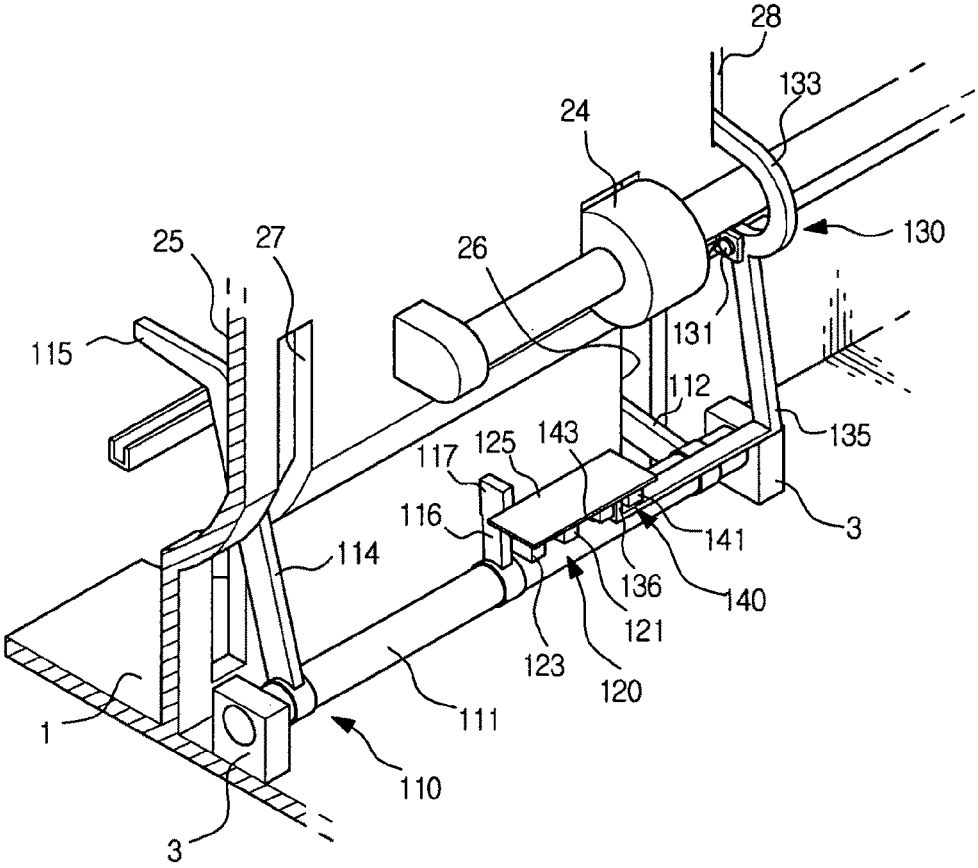
FIG. 4 is a view illustrating the printing medium sensing unit installed to a body of the image forming apparatus according to the embodiment.

FIG. 2 is a perspective view of a printing medium sensing unit according to the embodiment, FIG. 3 is a view illustrating a relationship between the paper supply unit and the printing medium sensing unit according to the embodiment, and FIG. 4 is a view illustrating the printing medium sensing unit installed to the body according to the embodiment.

Referring to FIGS. 2 to 4, the image forming apparatus of the present embodiment may include a printing medium sensing unit 100. The printing medium sensing unit 100 serves to sense whether or not the printing medium P is stored in the paper supply tray 11 separably mounted in the body 10, to sense a width W of the printing medium P, and to sense whether or not the printing medium P is fed to the printing path S.

The printing medium sensing unit 100, as illustrated in FIG. 2, may include a first actuator 110 to sense the presence of the printing medium P stored in the paper supply tray 11 and the width W of the printing medium P fed to the printing path S, a first sensor 120 to sense operation of the first actuator 110, a second actuator 130 to sense whether or not the printing medium P is fed to the printing path S, and a second sensor 140 to sense operation of the second actuator 130.

Signals sensed by the first sensor 120 and the second sensor 140 are transmitted to a controller (not shown) of the image forming apparatus, and the controller controls the image forming apparatus according to the signals from the first and second sensors 120 and 140.

The controller may be a microprocessor, microcontroller, or the like, including a Central Processing Unit (CPU) that performs various computer commands to control operations of the paper supply unit 10, developing unit 30, fusing unit 40 and discharge unit 50 or to perform various control operations. Also, the controller may include a memory device, such as a Random Access Memory (RAM), a Read-Only-Memory (ROM), and a flash memory.

The first actuator 110 may include a first rotating shaft 111, a first actuating arm 112 and a second actuating arm 114 arranged at opposite ends of the first rotating shaft 111, and a first sensing arm 116 arranged at the center of the first rotating shaft 111.

The first actuating arm 112, second actuating arm 114 and first sensing arm 116 are fixed to the first rotating shaft 111 respectively at first, second and third positions spaced apart from one another on the first rotating shaft 111, and may be rotated simultaneously along with the first rotating shaft 111 during rotation of the first rotating shaft 111.

The first actuating arm 112 serves to sense the presence of the printing medium P stored in the paper supply tray 11. To this end, the first actuating arm 112 may extend from the first rotating shaft 111 toward the paper supply tray 11, and may include a first contact portion 113, an upper end of which is obliquely bent upward to face a front end F of the printing medium P.

The second actuating arm 114 serves to sense the width W of the printing medium P fed to the printing path S defined within the body 1. To this end, the second actuating arm 114 may extend upward from the first rotating shaft 111, and may include a second contact portion 115, a distal end of which extends toward the paper supply tray 11 to selectively come into contact with the printing medium P fed to the printing path S according to the width W of the printing medium P.

To install the first actuator 110 to the body 1, as illustrated in FIGS. 3 and 4, either end of the first rotating shaft 111 may be rotatably supported by a supporting frame 3 installed to the body 1.

In this case, one of the feed guides 25, arranged close to the printing medium sensing unit 100, may be formed with a first slot 26 and a second slot 27, such that the first contact portion 113 of the first actuating arm 112 may protrude through the first slot 26 and the second contact portion 115 of the second actuating arm 114 may protrude through the second slot 27.

The first and second actuating arms 112 and 114 are normally forced to be rotated downward by gravity and thus, are rotated downward together so long as no external force acts thereon.

Considering an installation position of the first actuating arm 112 with respect to the body 1, to allow the first contact portion 113 of the first actuating arm 112 to press the front end F of the printing medium P regardless of the width W of the printing medium P, the first actuating arm 112 is located close to the width center of the body 1. The paper supply tray 11 may be formed in a front end thereof with an opening 12, to prevent the paper supply tray 11 from interfering with the first contact portion 113 of the first actuating arm 112 when the paper supply tray 11 is separated from or mounted into the body 1.

Figure 5:
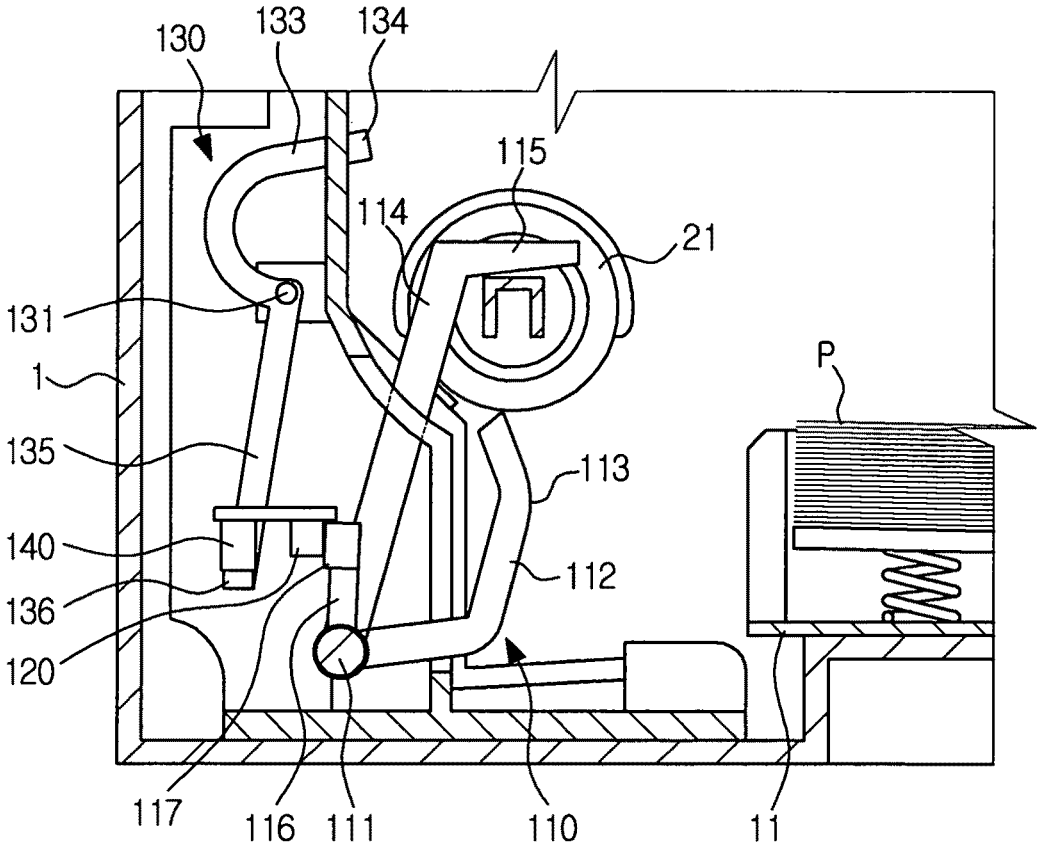
FIG. 5 is a view illustrating operation of the printing medium sensing unit when no printing media is stored in a paper supply tray according to the embodiment.
Figure 6:
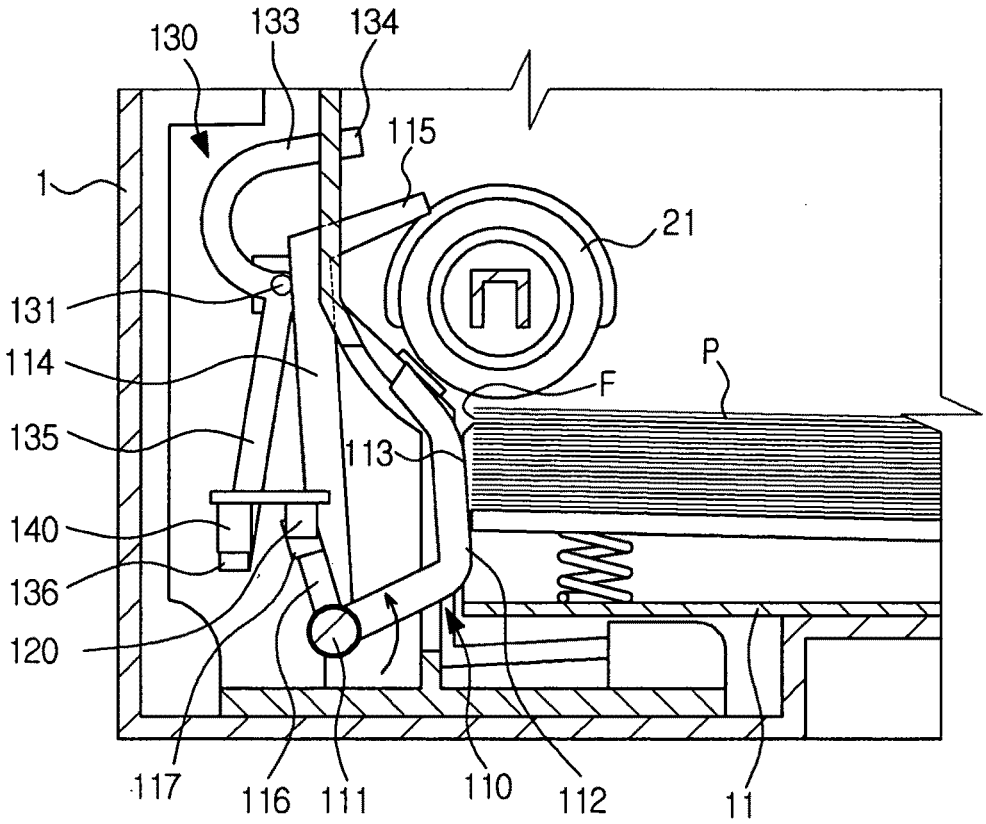
FIG. 6 is a view illustrating operation of the printing medium sensing unit when printing media is stored in the paper supply tray according to the embodiment.

With respect to a relationship between the first actuating arm 112 and the printing medium P, the first actuating arm 112 may be arranged rotatable between a first position where the first contact portion 113 of the first actuating arm 112 does not come into contact with the front end F of the printing medium P stored in the paper supply tray 11 (see FIG. 5) and a second position where the first contact portion 113 of the first actuating arm 112 is pressed and moved by the front end F of the printing medium P stored in the paper supply tray 11 (see FIG. 6).

Similarly, the second actuating arm 114, which is fixed to the first rotating shaft 111 and thus, is adapted to be rotated along with the first actuating arm 112, is rotatable between the first position and the second position.

Considering an installation position of the second actuating arm 114 with respect to the body 1, the second actuating arm 114 may be located close to a lateral surface of the body 1 so as to be moved via interference with a specific printing medium fed to the printing path S, i.e. a printing medium P2 having a width W of 190 mm or more, such as A4 paper, letter paper, legal paper, etc. (see FIG. 7).

Figure 9:
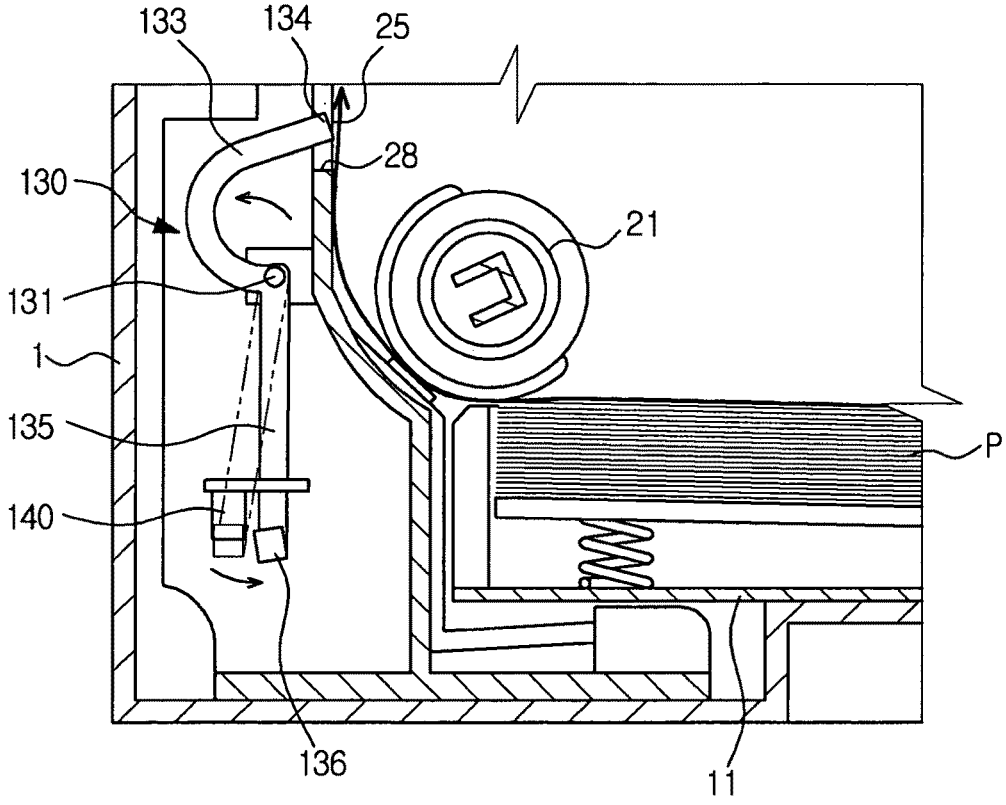
FIG. 9 is a view illustrating operation of a second actuator according to the embodiment.

With respect to a relationship between the second actuating arm 114 and the printing medium P, the second actuating arm 114 may be arranged rotatable from the second position (see FIG. 6) to a third position where the second actuating arm 114 is pressed and moved by the front end F of the printing medium P fed to the printing path S (see FIG. 9).

Referring to FIG. 2, the first sensor 120 serves to sense rotation of the first sensing arm 116 simultaneously happened with rotation of the first and second actuating arms 112 and 114. The first sensor 120 may be a photo sensor including a light emitting element 121, such as a light emitting diode, and a light receiving element 123, such as a phototransistor.

The first sensor 120 may be configured in such a manner that the light emitting element 121 and the light receiving element 123 are mounted on a printed circuit board 125 provided in the body 1 so as to face each other with a sensing space 127 defined therebetween.

The first sensing arm 116 may extend from the first rotating shaft 111 toward the first sensor 120, and may be provided at an end thereof with a first sensing portion 117 to be sensed by the first sensor 120.

The first sensing portion 117 of the first sensing arm 116 is movable into or out of the sensing space 127 between the light emitting element 121 and the light receiving element 123 according to rotation of the first rotating shaft 111. Based on change of a sensed signal from the sensor 120 (i.e. voltage change) caused when the first sensing portion 117 intercepts light that would otherwise be transmitted to the light receiving element 123, the presence of the printing medium P stored in the paper supply tray 11 and the width W of the printing medium P may be sensed.

In an initial state in which the paper supply tray 11 is partially withdrawn from the body 1, as illustrated in FIG. 5, the first sensing arm 116 may be located at the outside of the sensing space 127 of the first sensor 120 so as not to intercept the light to be transmitted from the light emitting element 121 to the light receiving element 123.

Although the present embodiment describes the first sensor 120 as being a photo sensor, other kinds of sensors may be used so long as they may sense positional change of the first sensing arm 116.

Referring to FIG. 2, the second actuator 130, used to sense whether or not the printing medium P is fed to the printing path S, may include a second rotating shaft 131, a third actuating arm 133 and a second sensing arm 135. The third actuating arm 133 may extend from the second rotating shaft 131 in a first direction toward the printing path S and may be provided at an end thereof spaced apart from the second rotating shaft 131 with a third contact portion 134 to come into contact with the printing medium P fed to the printing path S (see FIG. 3). The second sensing arm 135 may extend from the second rotating shaft 131 in a second direction toward the second sensor 140 and may be provided with a second sensing portion 136 to be sensed by the second sensor 140.

The second sensor 140 to sense operation of the second actuator 130 may be a photo sensor including a light emitting element 141 and a light receiving element 143.

To install the second actuator 130 to the body 1, as illustrated in FIG. 4, the second rotating shaft 131 may be rotatably installed to the body 1. The feed guide 25 is further formed with a third slot 28 such that the third contact portion 134 of the third actuating arm 133 may protrude through the third slot 28.

With the above described configuration, when the third contact portion 134 of the second actuator 130 protruding to the printing path S comes into contact with the printing medium P fed to the printing path S, the third actuating arm 133 is rotated upward about the second rotating shaft 131 and simultaneously, the second sensing arm 135 undergoes rotational displacement thus intercepting light that would otherwise be transmitted to the light receiving element 143.

The third actuating arm 133 is normally forced to be rotated downward by gravity. Accordingly, the third actuating arm 133 is kept at a downwardly rotated position when no external force is applied thereto. In such an initial position where no external force is applied, the second sensing portion 136 of the second sensing arm 135 is positioned in a sensing space between the light emitting element 141 and the light receiving element 143 of the second sensor 140, thus being sensed by the second sensor 140.

Hereinafter, operation of the printing medium sensing unit 100 provided in the image forming apparatus according to the embodiment of the present invention will be described.

First, as illustrated in FIG. 5, in a state wherein the paper supply tray 11 is not mounted in the body 1 or no printing medium P is stored in the paper supply tray 11, the first actuator 110 and the second actuator 130 are kept at the first position where they have been rotated downward by gravity.

In this case, the first sensing portion 117 of the first actuator 110 is located at the outside of the sensing space 127 of the first sensor 120 (see FIG. 2), and the second sensing portion 136 of the second actuator 130 is located in the sensing space of the second sensor 140.

Accordingly, the first sensor 120 does not sense the first sensing portion 117 of the first sensing arm 116 in a state wherein no printing medium P is stored in the paper supply tray 11. In this case, the controller of the image forming apparatus may recognize a current state as being in which normal implementation of a printing operation may be impossible.

As illustrated in FIG. 6, in a state wherein the printing medium P is stored in the paper supply tray 11 and thereafter, the paper supply tray 11 is mounted into the body 1, the front end F of the printing medium P comes into contact with the first contact portion 113 of the first actuating arm 112 thus acting to press the first contact portion 113. Thereby, the first actuator 110 rotated upward about the first rotating shaft 111 by a predetermined angle thus being moved to the second position.

In this case, the first sensing portion 117 of the first actuator 110 is located in the sensing space 127 of the first sensor 120, thus being sensed by the first sensor 120. Accordingly, the controller of the image forming apparatus may recognize a current state as being in which normal implementation of a printing operation may be possible.

Figure 7:
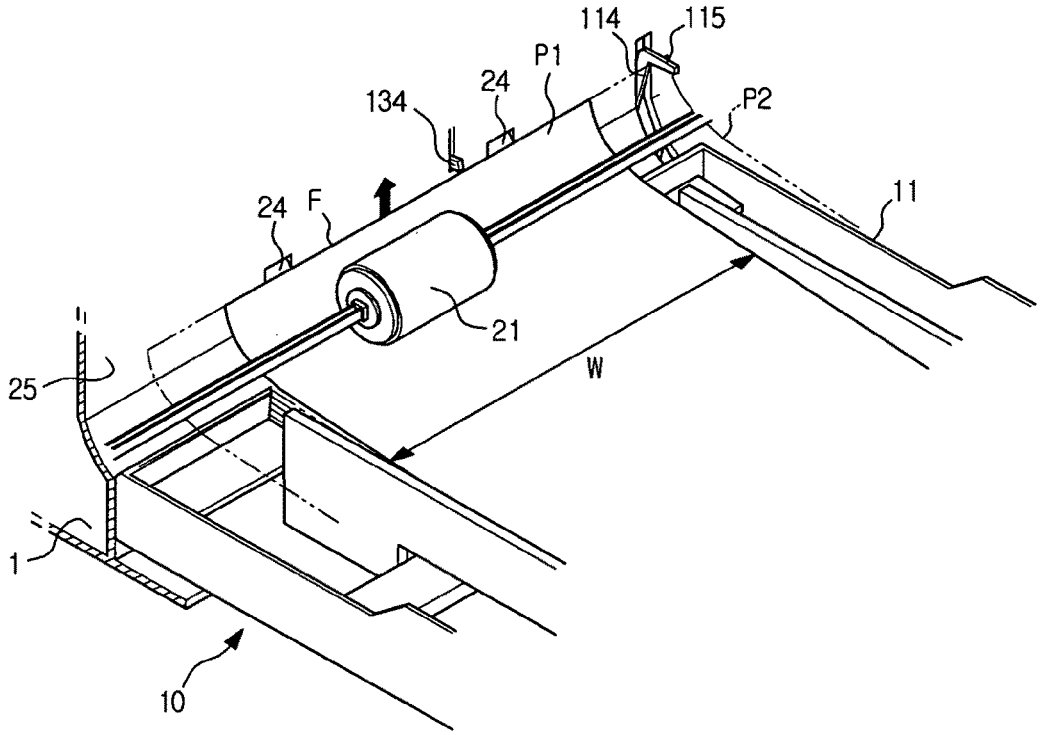
FIG. 7 is view illustrating a relationship between a width of a printing medium and a second actuating arm according to the embodiment.

Thereafter, if the image forming apparatus begins a printing operation, as illustrated in FIG. 7, the printing medium P stored in the paper supply tray 11 is picked up by the pickup member 21 and is fed to the printing path S above the paper supply unit 10.

In one example, if a printing medium P1 having a small width W is fed to the printing path S, the printing medium P1 does not come into contact with the second contact portion 115 of the second actuating arm 114, causing no rotation of the first actuator 110.

Thereby, as illustrated in FIG. 6, the first sensing portion 117 is continuously sensed by the first sensor 120 without change of a sensed signal. As a result, the controller of the image forming apparatus may recognize a current state as being in which the printing medium P1 having a small width of 190 mm or less is fed.

In this case, the controller may perform a control operation to increase a gap between the successively fed printing media P so as to feed the printing media P at a lower speed than a normal feed speed, or to lower a fusing temperature so as to prevent abnormal heat generation of the fusing unit 40.

Figure 8:
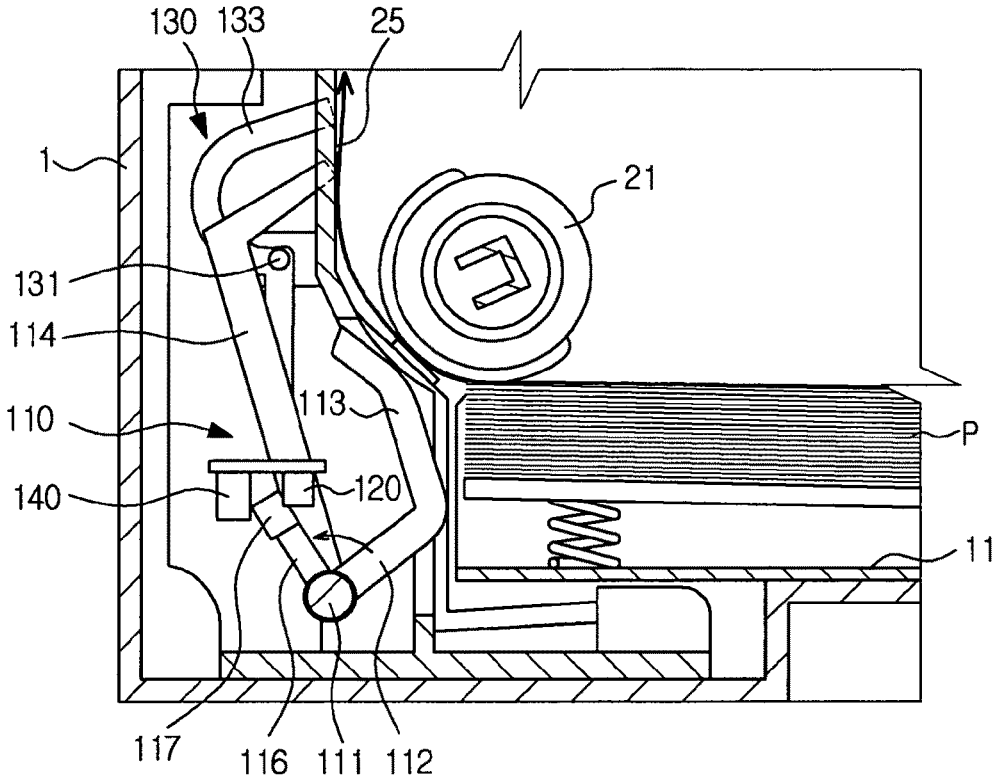
FIG. 8 is a view illustrating operation of the printing medium sensing unit when a printing medium having a large width is fed according to the embodiment.

In another example, if a printing medium P2 having a width of 190 mm or more is fed to the printing path S as illustrated in FIG. 7, the printing medium P2 comes into contact with the second contact portion 115 of the second actuating arm 114 protruding to the printing path S, thus acting to press the second contact portion 115. Thereby, the first actuator 110 is rotated upward about the first rotating shaft 111 by a predetermined angle, thus being moved from the second position as illustrated in FIG. 6 to the third position as illustrated in FIG. 8.

Accordingly, the first sensing portion 117 of the first actuator 110 is moved out of the sensing space 127 of the first sensor 120 and is not sensed by the first sensor 120, thus causing change of the sensed signal. As a result, the controller of the image forming apparatus may recognize a current state as being in which the printing medium P2 having a large width W is fed.

When the printing medium P2 having a large width W is fed, the controller controls a printing operation at a predetermined normal feed speed and fusing temperature.

If the printing medium P2 fed to the printing path S is released from the second contact portion 115 of the second actuating arm 114 and does not interfere with the second contact portion 115, the first actuator 110 is rotated downward by gravity. In this case, as illustrated in FIG. 6, the first contact portion 113 of the first actuating arm 112 comes into contact with the front end F of the printing medium P stored in the paper supply tray 11 and thus, movement of the first contact portion 113 is limited.

In this case, since the first sensing portion 117 is again sensed by the first sensor 120, it may be possible to accurately determine whether or not the printing medium P is stored in the paper supply tray 11.

With the above described configuration, in the printing medium sensing unit 100 of the image forming apparatus according to the present embodiment, a single actuator and a single sensor, i.e. the first actuator 110 and the first sensor 120 may perform two sensing functions to sense the presence of the printing medium P stored in the paper supply tray 11 and the width of the printing medium P. This may reduce manufacturing costs of the image forming apparatus and also, may accomplish a simplified interior configuration of the image forming apparatus.

In the meantime, as illustrated in FIG. 9, once the printing medium P stored in the paper supply tray 11 has picked up by the pickup member 21 so as to be fed to the printing path S, the third contact portion 134 of the second actuator 130 protruding to the printing path S (see FIG. 3) comes into contact with the front end F of the printing medium P. Thereby, as the third actuating arm 133 of the second actuator 130 is rotated upward about the second rotating shaft 131, the second sensing arm 135 is displaced to a position where it is impossible for the second sensor 140 to sense the second sensing arm 135.

Accordingly, the controller determines a time to transfer toner to the printing medium P from the photoconductor drum 31 on the basis of the displacement occurring time. Thereafter, once a rear end of the printing medium P passes through the second contact portion 115 of the second actuator 130, the second actuator 130 is returned to an initial position thereof by gravity, thus being sensed by the second sensor 140. As a result, the controller may sense that one sheet of the printing medium P is completely fed to the printing path S.

Hereinafter, relationships between the first actuator 110, the first sensor 120, the second actuator 130 and the second sensor 140 will be described in summary.

First, if no printing medium P is stored in the paper supply tray 11, the first actuator 110 is not sensed by the first sensor 120 and the second actuator 130 is sensed by the second sensor 140 (see FIG. 5).

After the printing medium P is stored into the paper supply tray 11, the first actuator 110 is sensed by the first sensor 120 and the second actuator 130 is continuously sensed by the second sensor 140 (see FIG. 6).

Upon printing of the large width printing medium P2 (see FIG. 3), if the printing medium P2 is picked up and is fed to the printing path S, the first actuator 110 is not sensed by the first sensor 120 (see FIG. 8) and the second actuator 130 is not sensed by the second sensor 140 (see FIG. 9).

On the other hand, upon printing of the small width printing medium P1 (see FIG. 3), if the printing medium P1 is picked up and is fed to the printing path S, the first actuator 110 is sensed by the first sensor 120 (see FIG. 6) and the second actuator 130 is not sensed by the second sensor 140 (see FIG. 9).

In conclusion, the first sensor 120 and the second sensor 140 generate different signals according to whether or not the printing medium P is stored in the paper supply tray 11 and whether or not the printing medium P is fed to the printing path S and according to the width W of the printing medium P fed to the printing path S. Accordingly, the controller may control a printing speed and fusing temperature of the image forming apparatus based on the sensed signals.

As apparent from the above description, an image forming apparatus according to the embodiment may sense the presence and width of printing media by use of a single sensor and a single actuator, thus achieving reduced manufacturing costs and improved productivity.

Although the embodiment has been shown and described, it would be appreciated by those skilled in the art that changes may be made in the embodiment without departing from the principles and spirit of the invention, the scope of which is defined in the claims and their equivalents.

What is claimed is:

1. An image forming apparatus including a body having a printing path; a paper supply tray separably mounted in the body, in which a printing medium is stored; a pickup member to pick up the printing medium stored in the paper supply tray sheet by sheet and to feed the picked up printing medium to the printing path; a first actuator to sense the presence of the printing medium stored in the paper supply tray and a width of the printing medium; and a first sensor to sense operation of the first actuator, wherein the first actuator comprises:

a first rotating shaft rotatably installed to one side of the body;

a first actuating arm extending from a first axial portion of the first rotating shaft and having a first contact portion to face a front end of the printing medium stored in the paper supply tray;

a second actuating arm extending from a second axial portion of the first rotating shaft and having a second contact portion to selectively come into contact with the printing medium according to the width of the printing medium that has picked up by the pickup member so as to be fed to the printing path; and a first sensing arm extending from a third axial portion of the first rotating shaft and having a first sensing portion to be sensed by the first sensor by being moved in linkage with the first and second actuating arms.

2. The image forming apparatus according to claim 1, wherein the first actuating arm, the second actuating arm and the first sensing arm are integrally formed with the first rotating shaft.

3. The image forming apparatus according to claim 1, wherein the width of the printing medium coming into contact with the second contact portion is at least about 190 mm.

4. The image forming apparatus according to claim 3, wherein the first actuator is rotatable between a first position where the first actuator is rotated downward by gravity, a second position where the first contact portion comes into contact with and is rotated by the front end of the printing medium stored in the paper supply tray, and a third position where the second contact portion comes into contact with and is rotated by the printing medium fed to the printing path.

5. The image forming apparatus according to claim 4, wherein the first sensing portion is not sensed by the first sensor at the first position, is sensed by the first sensor at the second position, and is not sensed by the first sensor at the third position.

6. The image forming apparatus according to claim 1, wherein the first sensor is a photo sensor including a light emitting element and a light receiving element, and is movable into or out of a sensing space defined between the light emitting element and the light receiving element.

7. The image forming apparatus according to claim 1, further comprising:

a second actuator to sense whether or not the printing medium is fed to the printing path; and a second sensor to sense operation of the second actuator, wherein the second actuator includes a second rotating shaft rotatably installed to the body;

a third actuating arm extending from the second rotating shaft in a first direction toward the printing path and having a third contact portion at an end thereof spaced apart from the second rotating shaft so as to come into contact with the printing medium that has picked up by the pickup member so as to be fed to the printing path; and a second sensing arm extending from the second rotating shaft in a second direction toward the second sensor and having a second sensing portion to be sensed by the second sensor.

8. The image forming apparatus according to claim 7, wherein the second actuator is rotatable between a first position where the second actuator is rotated downward by gravity so that the third contact portion protrudes to the printing path and a second position where the third contact portion comes into contact with and is rotated by the printing medium.

9. The image forming apparatus according to claim 8, wherein the second sensing portion is sensed by the second sensor at the first position, and is not sensed by the second sensor at the second position.

* * * * *